US012799730B2

(12) United States Patent
Kachkovsky et al.

(10) Patent No.: US 12,799,730 B2
(45) Date of Patent: Nov. 17, 2026

(54) WELDLESS ENCLOSURE

(71) Applicant: PRIDE Enterprises, Brandon, FL (US)

(72) Inventors: Oliver Kachkovsky, Jacksonville, FL (US); Taft Stone, Hastings, FL (US); Alvin Federico, Branford, FL (US)

(73) Assignee: PRIDE ENTERPRISES, Brandon, FL (US)

( * ) Notice: Subject to any disclaimer, the term of this patent is extended or adjusted under 35 U.S.C. 154(b) by 262 days.

(21) Appl. No.: 18/650,584

(22) Filed: Apr. 30, 2024

(65) Prior Publication Data

US 2024/0368877 A1 Nov. 7, 2024

Related U.S. Application Data

(60) Provisional application No. 63/463,118, filed on May 1, 2023.

(51) Int. Cl.
*E04B 1/24* (2006.01)
*E04B 1/00* (2006.01)

(52) U.S. Cl.
CPC .... *E04B 1/2403* (2013.01); *E04B 2001/2418* (2013.01); *E04B 2001/2448* (2013.01)

(58) Field of Classification Search
CPC ..... E04B 1/2403; E04B 1/388; E04B 2001/2418; E04B 2001/2448; E04B 2001/2415; E04B 2001/2406
USPC ..... 52/650.1
See application file for complete search history.

(56) References Cited

U.S. PATENT DOCUMENTS 1,729,694 A * 10/1929 Von Hagel ..... E04B 1/2403 403/387
1,748,794 A * 2/1930 Ray ..... E04B 1/24 52/657
2,926,941 A * 3/1960 Thompson ..... F16B 12/40 446/111
3,643,390 A * 2/1972 Shelley ..... E04B 1/34823 52/234
3,729,889 A * 5/1973 Baruzzini ..... F25D 23/063 D25/1
3,738,083 A * 6/1973 Shimano ..... E04B 1/34315 52/584.1

(Continued)

FOREIGN PATENT DOCUMENTS

AT 200768 B * 11/1958
CN 109688874 A * 4/2019 ..... A47B 47/042

(Continued)

*Primary Examiner* — Anna M Momper
*Assistant Examiner* — Joseph J. Sadlon
(74) *Attorney, Agent, or Firm* — NIXON & VANDERHYE P.C.

(57) ABSTRACT

An enclosure incorporates modular components for customizable dimensions. The enclosure includes a top profile with a topmost surface, a vertical surface, and a bottommost surface. The topmost surface of the top profile defines a top of the enclosure. A first bottom profile is provided on one side of the enclosure, and a second bottom profile is provided on an opposite side of the enclosure. A floor profile extends between the first bottom profile and the second bottom profile, and a plurality of corner profiles are connected between the top profile and the first and second bottom profiles via fasteners and without welding.

12 Claims, 6 Drawing Sheets

(56) References Cited

U.S. PATENT DOCUMENTS 3,753,583 A * 8/1973 Offenbroich ..... F16B 7/0446 403/297
3,866,365 A * 2/1975 Honigman ..... E04B 1/3444 52/66
3,885,362 A * 5/1975 Pollock ..... E04B 2/7409 52/270
3,925,875 A * 12/1975 Doke ..... F16B 5/045 52/666
4,041,659 A * 8/1977 McElhoe ..... E06B 3/721 52/639
4,074,811 A * 2/1978 Filak ..... E04H 6/00 248/245
4,078,847 A * 3/1978 Presnick ..... H05K 5/04 403/171
4,573,294 A * 3/1986 Lienhard ..... E04B 1/24 52/93.2
4,974,386 A * 12/1990 Eriksson ..... E04H 1/1238 312/111
5,083,844 A * 1/1992 Gruenberg ..... A47B 47/03 312/238
5,140,792 A * 8/1992 Daw ..... E04B 9/008 52/393
5,210,984 A * 5/1993 Eckel ..... E04B 1/8218 52/270
5,279,088 A * 1/1994 Heydon ..... E04H 3/02 52/223.6
6,082,070 A * 7/2000 Jen ..... E04H 12/2253 403/217
6,185,878 B1 * 2/2001 Bullard, III ..... E04B 1/6179 312/265.5
6,389,770 B1 * 5/2002 Santavicca ..... E04C 3/40 52/DIG. 17
9,057,190 B1 * 6/2015 Winter ..... E04F 15/04
10,174,507 B1 * 1/2019 Henbid ..... A01G 9/1407
10,648,167 B2 * 5/2020 Satchell ..... E04B 5/10
11,245,154 B2 * 2/2022 Rangelov ..... H01M 50/251
11,332,921 B2 * 5/2022 Ustinov ..... E04B 1/5831
11,473,294 B2 * 10/2022 Russell ..... E04B 1/08
11,746,522 B2 * 9/2023 Sobel ..... F16B 9/05 52/653.1
11,965,326 B2 * 4/2024 Simonsen ..... E04B 2/767
12,590,452 B2 * 3/2026 Bowron ..... E04B 1/2403
2003/0024205 A1 * 2/2003 Strickland ..... E04C 3/07 52/289
2005/0076605 A1 * 4/2005 Giaconi ..... E04B 1/2403 52/741.1
2008/0010909 A1 * 1/2008 Back ..... E04D 13/1478 52/650.1
2010/0031587 A1 * 2/2010 Weeks ..... E04C 3/07 52/126.6
2012/0124796 A1 * 5/2012 Ibanez ..... E04C 3/292 29/33 K
2020/0354947 A1 * 11/2020 Richard ..... E04B 1/2403
2023/0104556 A1 * 4/2023 Bowron ..... B66C 13/08 52/125.6
2024/0209620 A1 * 6/2024 Frederiks ..... E04B 1/2403
2024/0360659 A1 * 10/2024 De Rycke ..... E04B 1/2403

FOREIGN PATENT DOCUMENTS

PT 94191 A * 12/1991
SK 5373 Y1 * 3/2010

* cited by examiner

WELDLESS ENCLOSURE

CROSS-REFERENCES TO RELATED APPLICATIONS

This application claims the benefit of U.S. Provisional Patent Application No. 63/463,118, filed May 1, 2023, the entire content of which is herein incorporated by reference.

STATEMENT REGARDING FEDERALLY SPONSORED RESEARCH OR DEVELOPMENT (Not Applicable)

BACKGROUND

The invention relates to a weldless enclosure and, more particularly, to a weldless enclosure incorporating modular components enabling customized enclosure sizes with the component parts connected via fasteners such as rivets or the like and without welding.

There are countless uses for a box truck secured on a truck chassis. Depending on the intended use for the enclosure, existing box trucks require many welds to secure the walls, floor and roof together and on the chassis. The welding process can be tedious and time-consuming, and in some applications, weld lines on the box truck are undesirable.

SUMMARY

The enclosure construction of the described embodiments utilizes modular components to customize enclosure dimensions and eliminates weld lines. A series of modular profiles may be held together with high tensile rivets or other like connectors, all of which are hidden on the inside of the enclosure. The resulting appearance is much smoother and polished without weld lines.

In an exemplary application, the enclosure is described in the context of a commercial box truck, but the invention is not meant to be limited to the described application. With the modular components, any size enclosure could be contemplated for applications to, for example, enclosed cargo trailers, recreational campers, toolboxes, etc.

In an exemplary embodiment, an enclosure incorporating modular components for customizable dimensions includes a top profile, bottom profiles, a floor profile, and a plurality of corner profiles. The top profile includes a topmost surface, a vertical surface, and a bottommost surface, where the topmost surface of the top profile defines. The first bottom profile is on one side of the enclosure, and the second bottom profile is on an opposite side of the enclosure. The floor profile extends between the first bottom profile and the second bottom profile. The corner profiles are connected between the top profile and the first and second bottom profiles via fasteners and without welding.

The floor profile may be connected between the first bottom profile and the second bottom profile via fasteners and without welding.

Each of the first and second bottom profiles may include a two-piece construction including an L-bracket and a compound bracket, where the L-bracket is secured to the compound bracket, and where the compound bracket defines a connecting surface for the corner profiles. The compound bracket may include, in spatial order, a first tab abutting a distal end of the L-bracket, an inverse U-shaped riser including the first tab and defining a linking surface, the connecting surface extending from the inverse U-shaped riser, an exterior panel extending from the connecting surface, and a second tab overlaying an opposite end of the L-bracket. The L-bracket and the first tab may be secured to the floor profile via fasteners and without welding.

The top profile may include, in spatial order, the topmost surface, the vertical surface extending from the topmost surface, and the bottommost surface extending from the vertical surface, where the corner profiles may be connected to the bottommost surface via fasteners without welding. The top profile may further include a vertical flange parallel with the vertical surface and connected to the bottommost surface, where the vertical flange defines an internal chamber in the top profile.

The enclosure may include multiple ones of the top profile, where each of the top profiles may include a bent section parallel with the vertical surface. The bent sections of the multiple ones of the top profile may be connected together via fasteners and without welding. The enclosure may still further include a roof center joining strip joining the topmost surfaces of adjacent top profiles.

In another exemplary embodiment, an enclosure incorporating modular components to customize enclosure dimensions and eliminate weld lines includes a series of modular profiles held together via fasteners and without welding, where the fasteners are hidden on an inside of the enclosure.

The series of modular profiles may include a top profile that defines a top or roof of the enclosure, a bottom profile to which a floor is connected, and a corner profile extending between the top profile and the bottom profile. The top profile may include a topmost surface that defines the top or roof of the enclosure, where a size of the topmost surface is customized according to a desired size of the enclosure. The corner profile may include exterior sides that are customized according to the desired size of the enclosure.

BRIEF DESCRIPTION OF THE DRAWINGS

These and other aspects and advantages will be described in detail with reference to the accompanying drawings, in which.

DETAILED DESCRIPTION

Figure 1:
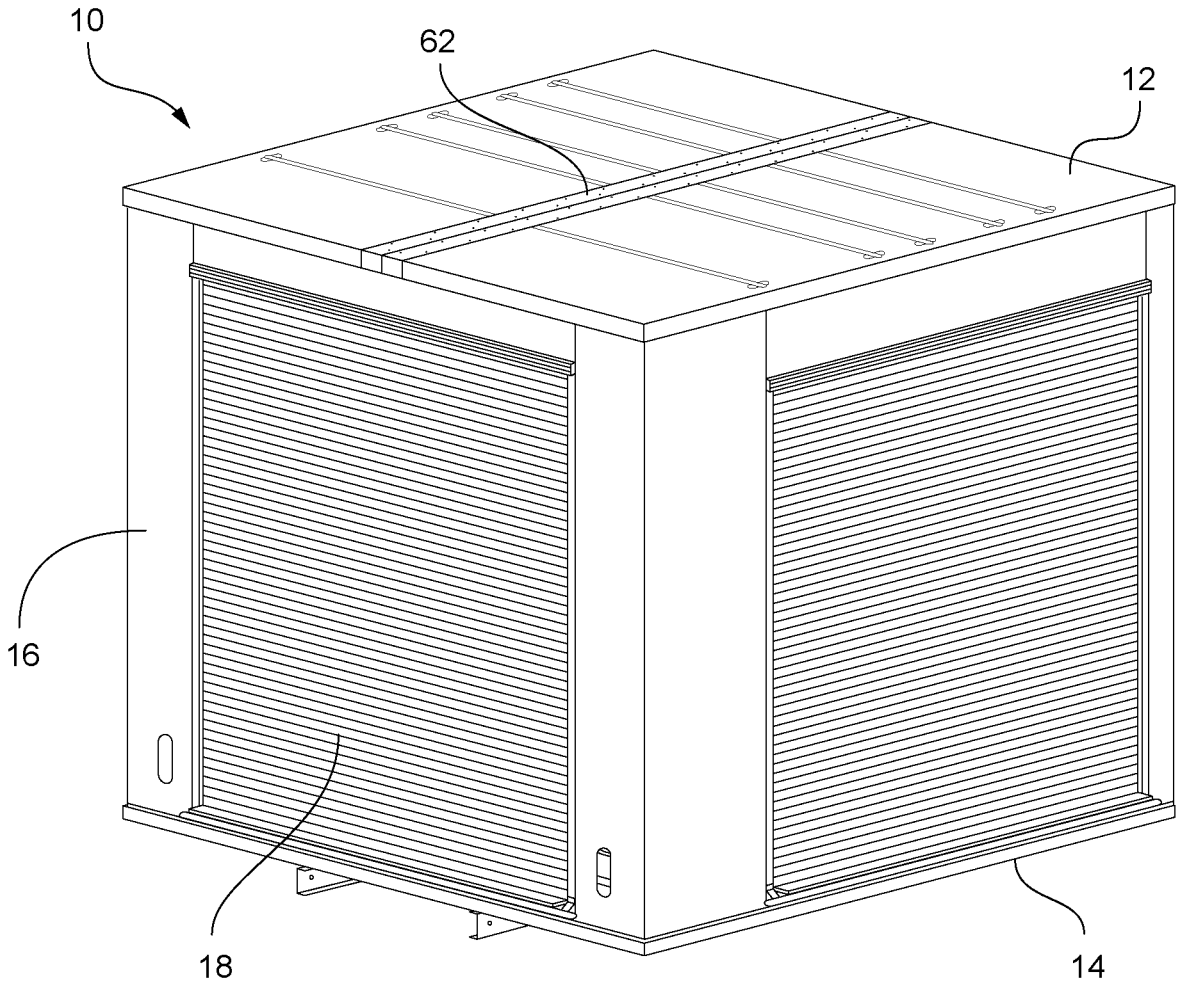
FIG. 1 is an exemplary truck box enclosure assembled with the modular components of the described embodiments.

FIG. 1 shows an exemplary enclosure in the form of a box truck for installation on a truck chassis. As noted, the concepts and features of the described embodiments are applicable to countless types of enclosures, and the invention is not meant to be limited to the illustrated exemplary embodiment.

Figure 2:
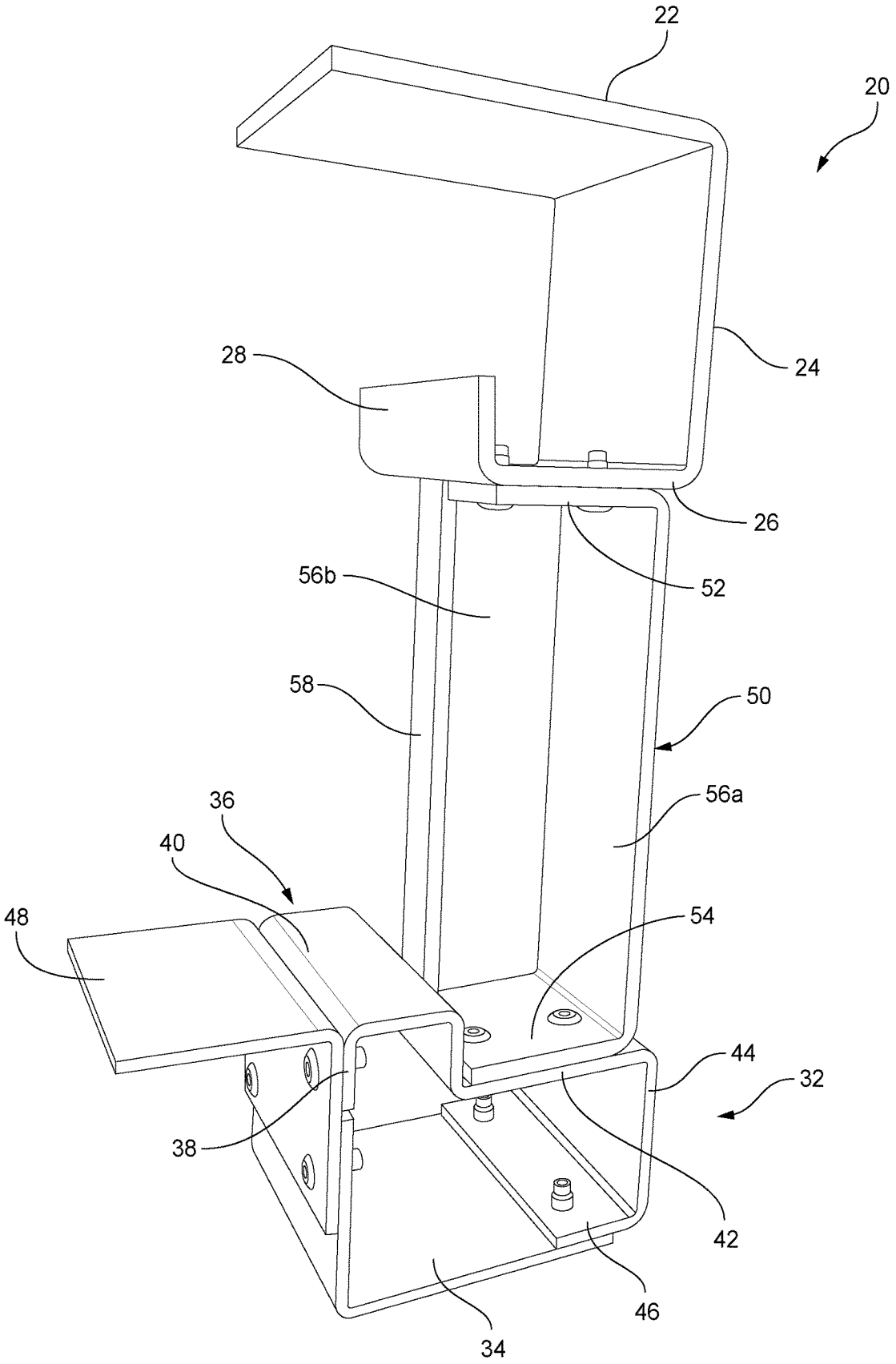
FIGS. 2 and 3 are perspective sectional views of the enclosure components.
Figure 3:
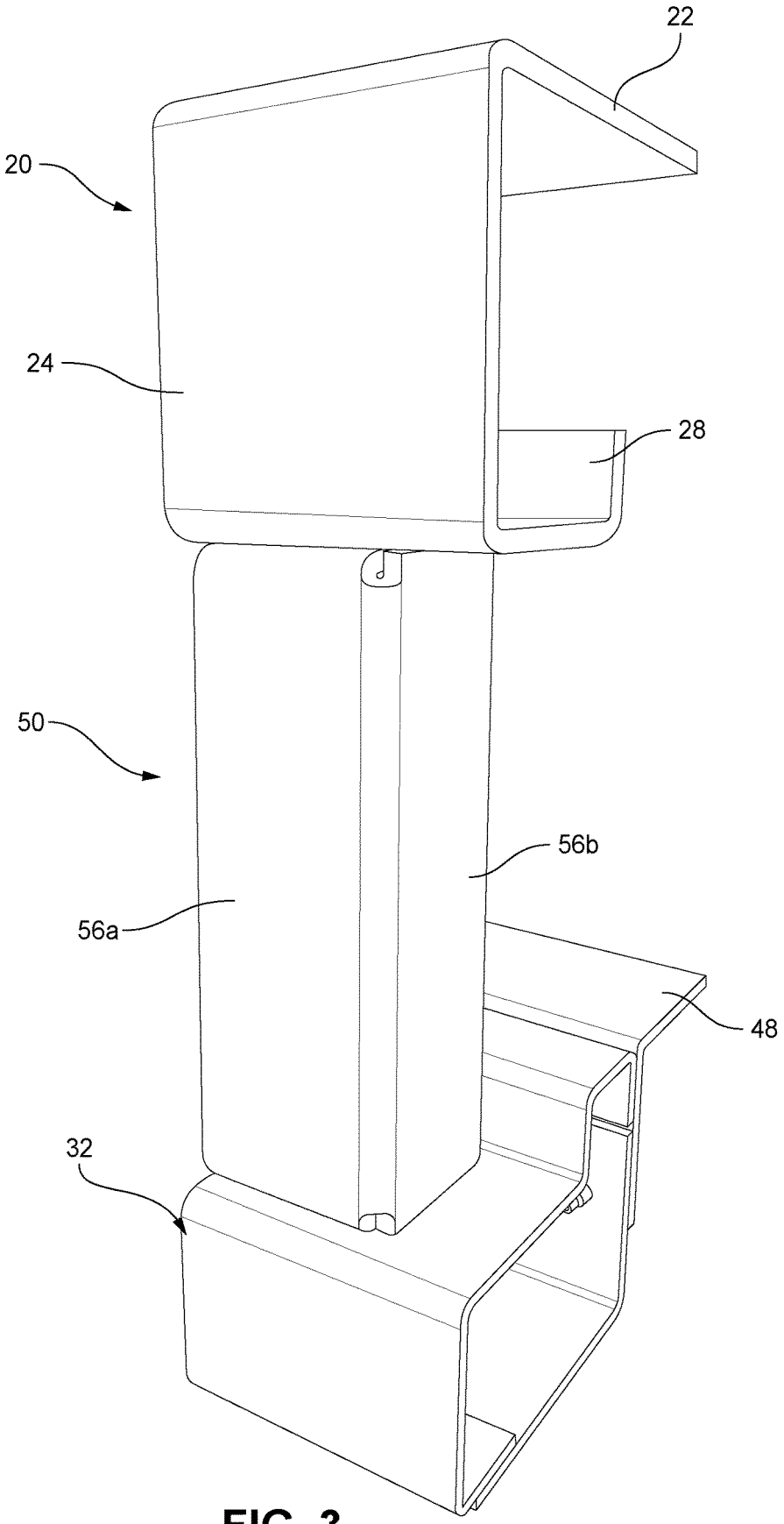

In the exemplary construction shown in FIG. 1, the box 10 includes a roof 12, a floor 14, corner sections 16 and access doors 18. FIGS. 2 and 3 are sectional views of the modular components assembled to construct the enclosure 10.

The modular components include a top profile 20 with a topmost surface 22, a vertical surface 24, and a bottommost surface 26. In spatial order, the top profile 20 includes the topmost surface 22, the vertical surface 24 extending from the topmost surface 22, and the bottommost surface 26 extending from the vertical surface 24. In some embodiments, the top profile 20 may also be provided with a vertical flange 28 that is parallel with the vertical surface 24 and connected to the bottommost surface 26. The vertical flange 28 defines an internal chamber in the top profile 20 that could be used as a wire chase or the like. The topmost surface 22 of the top profile 20 defines the top or roof 12 of the enclosure 10. A distal end of the topmost surface 22 (not shown in FIGS. 2-3) may include a further bent section 30 (FIG. 5) to connect to a distal end of an adjacent top profile. This structure can accommodate larger spans for the topmost surface 22 depending on the desired size of the enclosure.

A bottom profile 32 may include a two-piece construction with an L-bracket 34 and a compound bracket 36. The L-bracket 34 is secured to the compound bracket 36. In spatial order, the compound bracket 36 includes a first tab 38 abutting a distal end of the L-bracket 34, an inverse U-shaped riser 40 including the first tab 38 and defining a linking surface, a connecting surface 42 extending from the inverse U-shaped riser 40, an exterior panel 44 extending from the connecting surface 42, and a second tab 46 overlaying an opposite end of the L-bracket 34.

Figure 4:
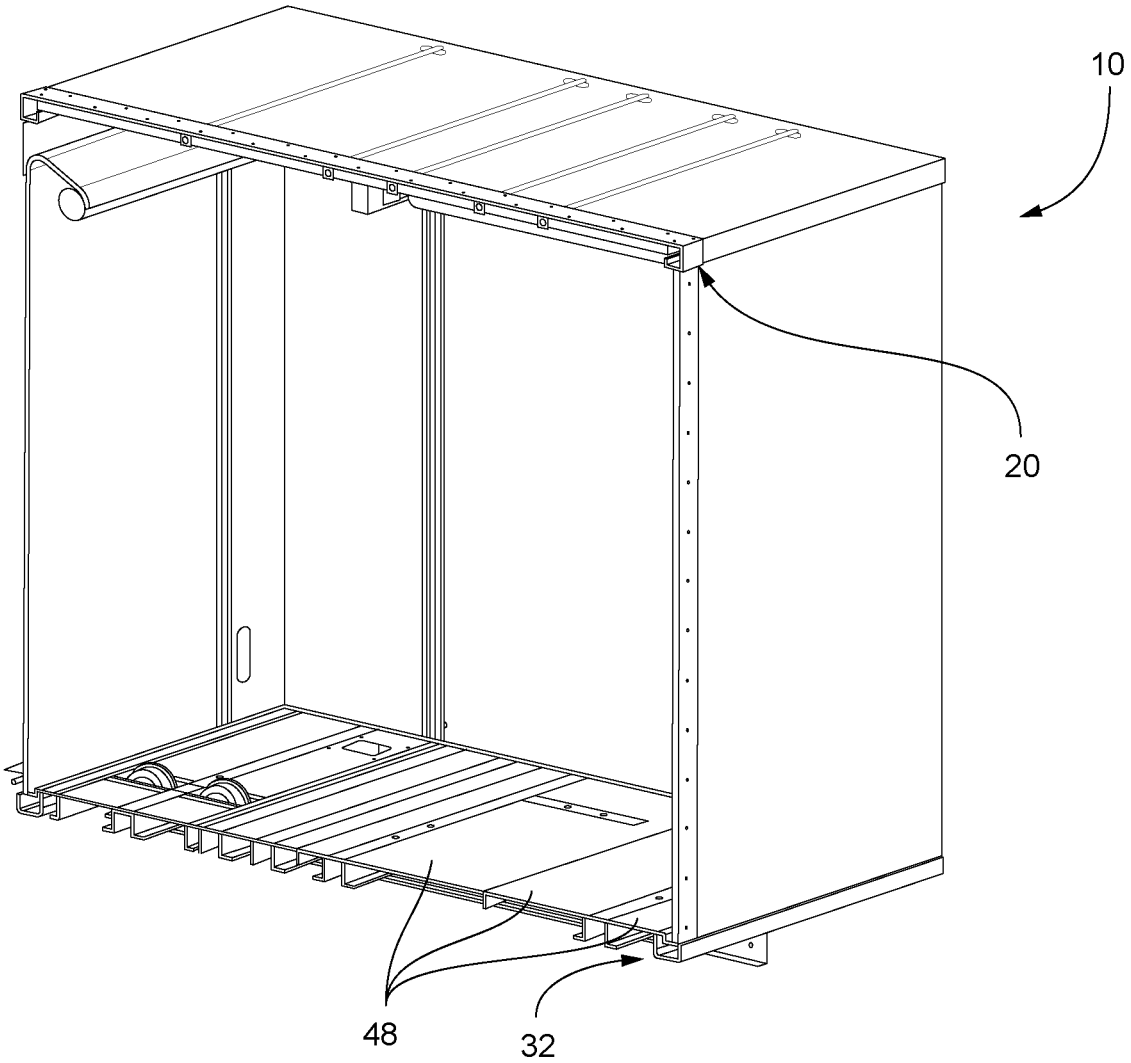
FIG. 4 is a sectional view through the enclosure.
Figure 5A:
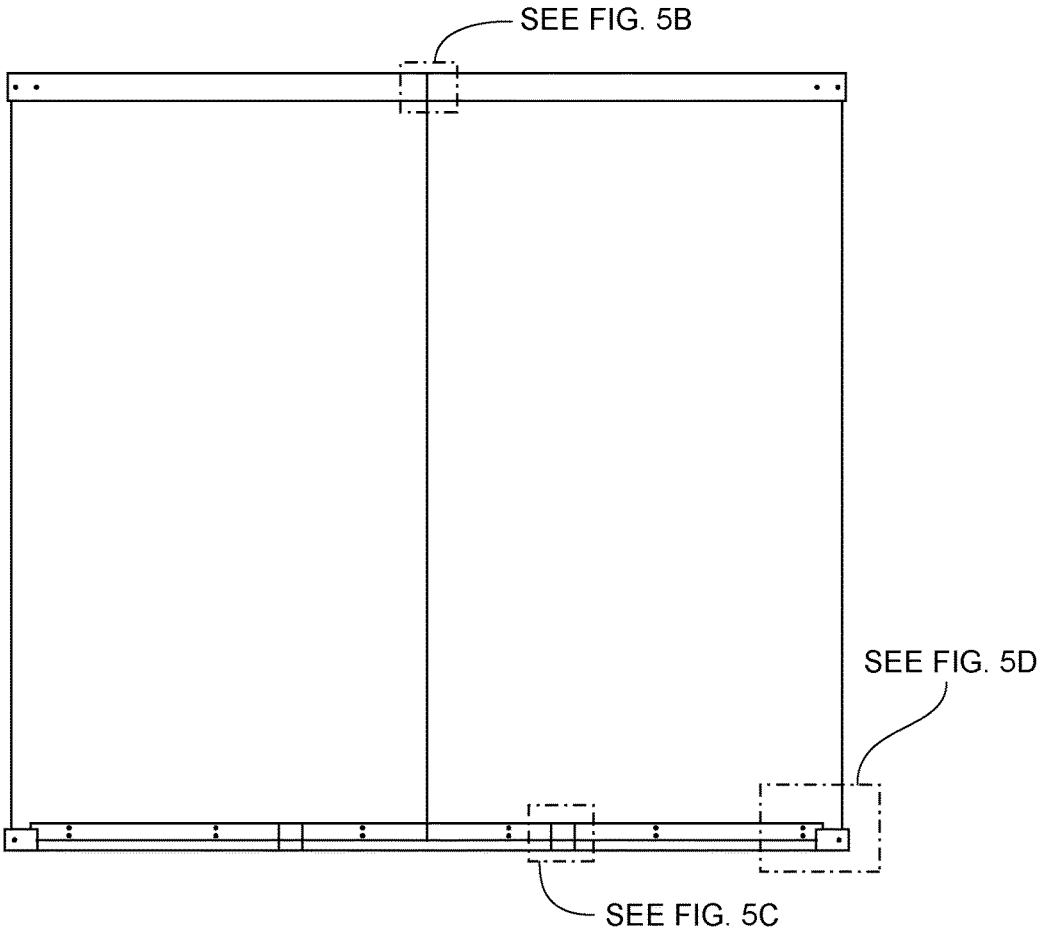
FIGS. 5A-5D show various sections of the enclosure and the connections among the various modular parts.
Figure 5B:
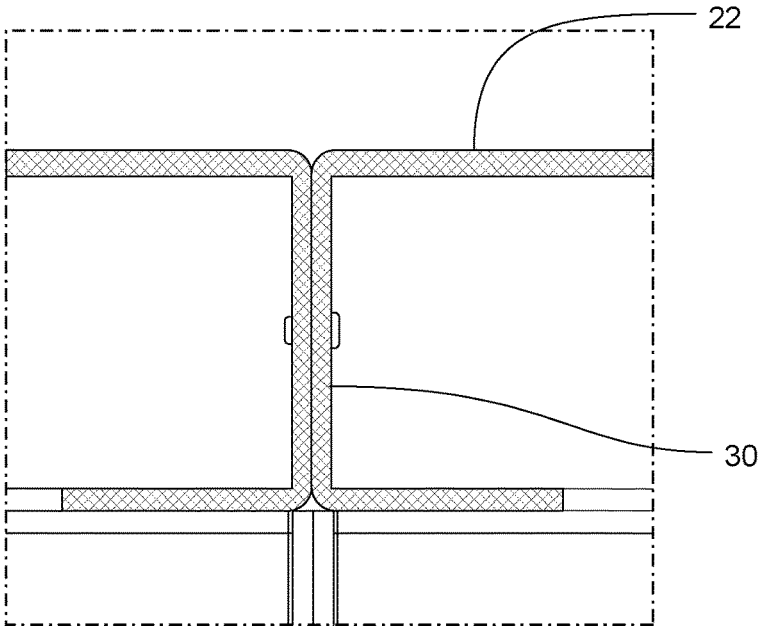
Figure 5C:
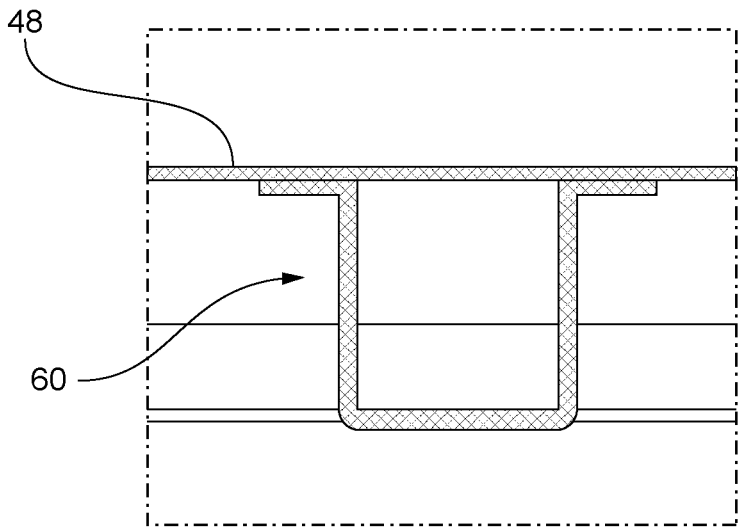
Figure 5D:
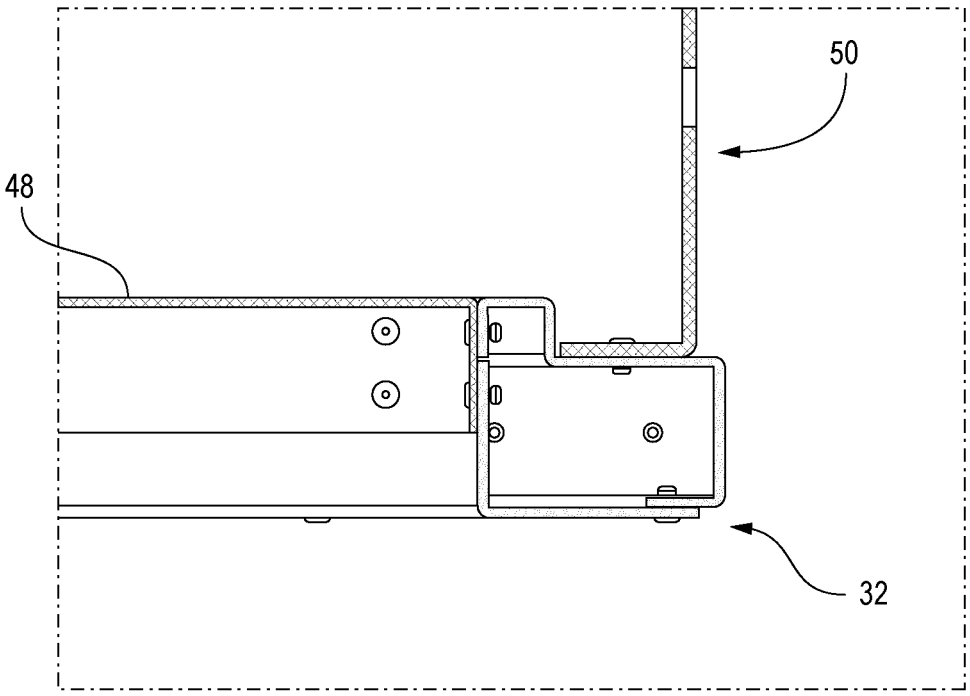

With reference to FIG. 4, the enclosure 10 may include first and second bottom profiles 32 on opposite sides of the enclosure 10. A floor profile 48 including one or multiple components extends between the first and second bottom profiles 32. As shown in FIG. 2, the floor profile 48 also serves to connect the L-bracket 34 to the compound bracket 36. With reference to FIG. 5, in some embodiments, the enclosure may include an underfloor bracket 60 secured to the floor profile 48 for connecting to a vehicle chassis or the like.

A plurality of corner profiles 50 are connected between the top profile 20 and the bottom profile(s) 32. The corner profiles 50 include an upper connecting surface 52 and a lower connecting surface 54 as well as exterior sides 56*a*, 56*b* and a connecting tab 58. The upper connecting surface 52 engages the bottommost surface 26 of the top profile 20, and the lower connecting surface 54 engages the connecting surface 42 of the bottom profiles 32. In some embodiments, all of the connections between the various components are effected via fasteners such a rivets or the like and without welding. Rivet holes may be formed by laser cut or the like, with rivets secured in a conventional manner. An adhesive sealant may be applied between all of the connected surfaces.

The topmost surfaces 22 of adjacent top profiles 20 may be joined with a roof center joining strip 62 (FIG. 1). Although the exemplary construction shown in FIGS. 1 and 4 shows access doors 18, the enclosure 10 could alternatively incorporate sidewalls by extending a width of the corner profiles 50. Exterior portions of the completed enclosure may also include facings or covers over open ends of the profiles that are secured with corner brackets or the like to provide a finished appearance.

In some embodiments, the material for the various profiles is 3/16 inch aluminum or steel depending on the desired strength of the enclosure. Alternatively, a thinner metal could be used. Each of the profiles is constructed by first cutting the fastener holes. Subsequently, a press brake may be used to form bends in the metal, and the profile parts are subsequently subjected to a powder coat painting process. The profiles can be formed in various sizes with varying structural characteristics to create a custom enclosure. By limiting or eliminating weld connections, the resulting product has a much cleaner and polished appearance.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. An enclosure incorporating modular components for customizable dimensions, the enclosure comprising:

a top profile including a topmost surface, a vertical surface, and a bottommost surface, the topmost surface of the top profile defining a top of the enclosure;

a first bottom profile on one side of the enclosure;

a second bottom profile on an opposite side of the enclosure;

a floor profile extending between the first bottom profile and the second bottom profile; and a plurality of corner profiles connected between the top profile and the first and second bottom profiles via fasteners and without welding, wherein each of the first and second bottom profiles comprise a two-piece construction including an L-bracket and a compound bracket, the L-bracket being secured to the compound bracket, wherein the compound bracket defines a connecting surface for the corner profiles, and wherein the compound bracket comprises, in spatial order, a first tab abutting a distal end of the L-bracket, an inverse U-shaped riser including the first tab and defining a linking surface, the connecting surface extending from the inverse U-shaped riser, an exterior panel extending from the connecting surface, and a second tab overlaying an opposite end of the L-bracket.

2. An enclosure according to claim 1, wherein the floor profile is connected between the first bottom profile and the second bottom profile via fasteners and without welding.

3. An enclosure according to claim 1, wherein the L-bracket and the first tab are secured to the floor profile via fasteners and without welding.

4. An enclosure according to claim 1, wherein the top profile comprises, in spatial order, the topmost surface, the vertical surface extending from the topmost surface, and the bottommost surface extending from the vertical surface, wherein the corner profiles are connected to the bottommost surface via fasteners without welding.

5. An enclosure according to claim 4, wherein the top profile further comprises a vertical flange parallel with the vertical surface and connected to the bottommost surface, the vertical flange defining an internal chamber in the top profile.

6. An enclosure according to claim 1, comprising multiple ones of the top profile, wherein each of the top profiles comprises a bent section parallel with the vertical surface, wherein the bent sections of the multiple ones of the top profile are connected together via fasteners and without welding.

7. An enclosure according to claim 6, further comprising a roof center joining strip joining the topmost surfaces of adjacent top profiles.

8. An enclosure incorporating modular components to customize enclosure dimensions and eliminate weld lines, the enclosure comprising:

a series of modular profiles held together via fasteners and without welding, wherein the fasteners are hidden on an inside of the enclosure;

a top profile including a topmost surface defining a top or roof of the enclosure;

a first bottom profile on one side of the enclosure;

a second bottom profile on an opposite side of the enclosure;

a floor profile extending between the first bottom profile and the second bottom profile; and a plurality of corner profiles connected between the top profile and the first and second bottom profiles, wherein each of the first bottom profile and the second bottom profile comprises a two-piece construction including an L-bracket and a compound bracket, the L-bracket being secured to the compound bracket, wherein the compound bracket defines a connecting surface for the corner profile, and wherein the compound bracket comprises, in spatial order, a first tab abutting a distal end of the L-bracket, an inverse U-shaped riser defining a linking surface, the connecting surface extending from the inverse U-shaped riser, an exterior panel extending from the connecting surface, and a second tab overlaying an opposite end of the L-bracket.

9. An enclosure according to claim 8, wherein the top profile comprises a vertical surface coupled with the topmost surface and a bottommost surface coupled with the vertical surface.

10. An enclosure according to claim 9, wherein the top profile comprises, in spatial order, the topmost surface, the vertical surface extending substantially perpendicularly from the topmost surface, and the bottommost surface extending substantially perpendicularly from the vertical surface, wherein the corner profiles are connected to the bottommost surface via fasteners without welding.

11. An enclosure according to claim 8, wherein the top profile includes a topmost surface that defines the top or roof of the enclosure, a size of the topmost surface being customized according to a desired size of the enclosure, and wherein the corner profile includes exterior sides that are customized according to the desired size of the enclosure.

12. An enclosure according to claim 11, wherein the corner profile comprises an upper connecting surface and a lower connecting surface between which the exterior sides are connected, the upper connecting surface engaging a bottommost surface of the top profile, and a lower connecting surface engaging a connecting surface of the bottom profile.

* * * * *